United States Patent [19]

Shaffer et al.

[11] 4,013,593

[45] Mar. 22, 1977

[54] FRAGRANCE COMPOSITIONS CONTAINING N-(2-FURFURYL)-PYRROLE

[75] Inventors: Gary W. Shaffer, Wayne; Irene Tornell, Woodcliff Lake; Kenneth L. Purzycki, Lake Parsippany, all of N.J.

[73] Assignee: Givaudan Corporation, Clifton, N.J.

[22] Filed: Nov. 10, 1975

[21] Appl. No.: 630,235

[52] U.S. Cl. ..... 252/522

[51] Int. Cl.[2] ..... C11B 9/00

[58] Field of Search ..... 252/522

[56] References Cited

OTHER PUBLICATIONS

M. A. Gianturco et al., *Tetrahedron*, vol. 20, pp. 2951–2961, 1964.

*Primary Examiner*—Veronica O'Keefe

*Attorney, Agent, or Firm*—Thomas Cifelli, Jr.

[57] ABSTRACT

Methods for improving fragrance compositions by adding thereto N-(2-furfuryl)-pyrrole and said improved compositions.

13 Claims, No Drawings

FRAGRANCE COMPOSITIONS CONTAINING N-(2-FURFURYL)-PYRROLE

BACKGROUND OF THE INVENTION

1. Field of the Invention

Odorant Compositions.

2. Description of the Prior Art

Many of the highly desirable odorant materials used in the perfume industry are essential oils derived from natural sources and are subject to the vagaries of natural products such as, availability in sufficient quantities, price fluctuations, variations in quality, etc. There is, therefore, a constant effort in the industry to provide substitutes for these natural products by using chemical starting materials which do not depend on the natural source.

Essential oils are made up of a number of different components which, in combination, give the desirable odor characteristic of the natural oil. It has been found, however, that even in those cases wherein the application of modern analytical and synthetic techniques allows most of the chemicals in an essential oil to be isolated, identified, synthesized and combined in the same relative amounts found in the oil, the product so produced usually lacks the "naturalness" and "lift" found in the natural oil.

The term "naturalness" refers to that quality in the natural oil which gives it a pleasant blended odor without the odor of any individual chemical "standing out" from the total bouquet of the oil. The term "lift" refers to that quality in the natural oil which gives it the initial impact and odor intensity when first perceived by the olfactory senses. Obviously, the lack of these qualities in a synthetic essential oil limits its value and commercial acceptance.

It is generally felt that these qualities, lacking in the synthetic oil but evident in the natural oil, are due to constituents present in the natural oil in minor amounts and which, in the great preponderance of cases, escape analytical detection and/or identification. While the modus operandi of such constituents is not known, occasionally a chemical is found which, when added to a synthetic essential oil, causes it to acquire the qualities of naturalness and lift. Apparently such a phenomenon occurs irrespective of the odor of such a constituent which may be desirable or undesirable in the pure form.

The N-(2-furfuryl)-pyrrole used in this invention was previously disclosed as a volatile constituent in coffee and a method for its preparation is known. (M. A. Gianturco, A. S. Giammarino, P. Friedel and V. Flanagan, *Tetrahedron*, 20, 2951, (1964)). The use of N-(2-furfuryl)-pyrrole in improving fragrance compositions is heretofore unknown.

SUMMARY OF THE INVENTION

The compound N-(2-furfuryl)-pyrrole has a sharp, green, mushroom odor. A compound having such odor characteristics would normally find little use in the art of perfumery. It is the surprising and unexpected finding of this invention that small amounts added to fragrance compositions improve such compositions via an unexplained mechanism whereby the fragrance composition has more naturalness and lift.

The fragrance compositions of this invention would include any fragrance material which comprises materials other than natural oils. In addition to duplications of natural essential oils, there is included any fragrance composition having synthetic constituents.

Since the perfume arts are subjective and depend on the personal preferences of the perfumer, and since the amount of N-(2-furfuryl)-pyrrole desired depends on the nature of the fragrance composition, it is preferred to practice this invention by adding the N-(2-furfuryl)-pyrrole in increasing amounts to the fragrance composition in question to determine the preferred amount. Such a procedure is within the normal operating methods of a perfumer skilled in the art who refines his fragrances by altering the relative amounts of the components. While certain preferred limits for certain fragrance compositions will be offered herein as illustration, it should be understood that the amounts to be used will depend on the skill and preference of the perfumer.

It should also be understood that this invention has shown general utility in all fragrance materials having synthetic constituents that have been tested. While in some cases the effect is minimal, in most cases the beneficial effect is most surprising. By using the method as disclosed herein, a perfumer can find the optimal amount to be used in each case by routine procedures. While a number of examples are provided to illustrate this invention in fragrance compositions as diverse as floral types, citrus types, and woody types, the scope is not limited to these. These examples are offered for illustration and are not intended to be limiting. Our experience has been, that the addition of small amounts of N-(2-furfuryl)-pyrrole is beneficial to a fragrance composition in a great preponderance of the cases providing a naturalness and lift which is lacking in the composition without the N-(2-furfuryl)-pyrrole.

DESCRIPTION OF THE PREFERRED EMBODIMENTS

In the practice of this invention it is preferred to determine the optimal amount of N-(2-furfuryl)-pyrrole by checking it at various levels. This can be done by a number of obvious techniques such as, providing a number of samples of varying concentrations, diluting a concentrated sample, adding increasing amounts to a sample or the like.

The preferred amount of N-(2-furfuryl)-pyrrole used will usually be from about 0.005 to about 1.0% of the odorant base, but amounts outside this range may be desirable and are not excluded. Normally, the useful range runs from a point where effect is hardly detectable to the point where the sharp, green, mushroom odor of the N-(2-furfuryl)-pyrrole is distinguishable.

The preferred amount of N-(2-furfuryl)-pyrrole added will also vary considerably with the type of fragrance composition, but in general the limits of from about 0.005 to about 1.0% apply. We prefer to add the compound to a sample of the fragrance composition in parts per million per part of fragrance base and to increase the amount until the most desirable effect is achieved.

For example, when N-(2-furfuryl)-pyrrole was added to a geranium base between the limits of 0.005 and 0.2%, the preferred amount was found to be between 0.01 and 0.1%. The effect of the N-(2-furfuryl)-pyrrole was to provide a very noticeable effect of enhancing the natural green-leafy-rosey character of the geranium and to provide great lift.

Further illustration is provided when added to a rose composition in the preferred range of 0.5 to 1.0% wherein great lift was provided to the rich, tenacious rose odor. Similar beneficial effects have been noted in other floral compositions.

Addition of N-(2-furfuryl)-pyrrole to a synthetic lemon oil in the preferred range of 0.01–0.05% provides a very natural lemon peel quality to the composition. It was also found that the sharpness of the monoterpene hydrocarbon odor, a typical and undesirable quality of synthetic citrus oils, is decreased and blended by the addition of N-(2-furfuryl)-pyrrole. Similar beneficial effects have been noted in other compositions of the citrus type.

Addition of N-(2-furfuryl)-pyrrole to synthetic fragrance compositions of the precious wood type tends to round off harsh notes, lift the woody odors, and provide a more natural bouquet. The range preferred in woody-type bases is apparently from about 0.01 to about 0.1%.

In all cases larger amounts can be used if the special effects produced are desirable.

It is the object of this inventon to provide the perfumer with a method for improving fragrances by adding thereto an amount of N-(2-furfuryl)-pyrrole. It is a further object to provide improved fragrance compositions wherein the improvement comprises the addition of small amounts of N-(2-furfuryl)-pyrrole. The amounts used will be such as to meet the needs of the perfumer.

The following examples are provided to illustrate embodiments of this invention as it is now preferred to practice it. It will be understood that such examples are merely illustrative and the invention is to be limited thereto only as indicated in the claims. Unless otherwise indicated, perfume ingredients are given in parts/thousand by weight. It will also be understood that the term "fragrance compositions" includes fragrance bases, perfumes, toilet waters and the like. The "fragrance base" is the odorant composition without the diluent needed to make a perfume etc. and is a "fragrance composition".

EXAMPLE I

The use of N-(2-furfuryl)-pyrrole in floral compositions is illustrated by adding it to the following geranium bourbon base.

| GERANIUM BOURBON BASE | |
|---|---|
| Components | Parts |
| Dimethyl sulfide, 1% solution | 8 |
| Roseoxide | 15 |
| Piperitone | 1 |
| Leaf Alcohol | 7 |
| 2-Hexenal, 10% solution | 2 |
| Neryl acetate | 1 |
| Phenylethyl acetate | 1 |
| Menthone, racemic | 3 |
| Amyl alcohol, 10% solution | 2 |
| Phellandrene | 3 |
| Diacetyl | 3 |
| Phenylethyl alcohol | 1 |
| Geranyl formate | 5 |
| Methylphenyl acetate | 4 |
| iso-Pulegol | 10 |
| Dimethyl octanol | 16 |
| Citronellyl formate | 10 |
| iso-Menthone | 15 |
| iso-Octanol | 30 |
| Citronellol | 210 |
| Linalool | 220 |
| Geraniol | 430 |
| Diphenyl oxide, 10% solution | 1 |
| Menthol brazil, cryst. | 1 |
| 3,5-Dimethyl-3-cyclohexene-1-carboxaldehyde | 3 |
| Phenylacetaldehyde | 1 |
| Geranium Bourbon | 118 |

-continued

| GERANIUM BOURBON BASE | |
|---|---|
| Components | Parts |
| | 1121 pts. |

The addition of N-(2-furfuryl)-pyrrole in the range of 50 ppm to 0.2% to the foregoing synthetic geranium bourbon base provides a very noticeable effect of enhancing geranium's natural green-leafy-rosey character combined with a great lift. The sample having about 0.05% was judged optimal.

EXAMPLE II

The use of N-(2-furfuryl)-pyrrole in floral compositions at a somewhat higher level is illustrated in the following rose base.

| ROSE COMPOSITION (Rosa Contifolia Type) | |
|---|---|
| Components | Parts |
| Rhodinol | 250 |
| Citronellol | 350 |
| Phenylethyl alcohol | 100 |
| Jasmin, synthetic | 100 |
| Cinnamyl cinnamate | 60 |
| Alpha ionone | 40 |
| Phenylethyl formate | 20 |
| Anisic alcohol | 4 |
| Ethyl methyl phenyl glycidate | 1 |
| Undecylic aldehyde, 10% solution | 4 |
| Nonyl aldehyde, 10% solution | 20 |
| Rose Otto, bulgarian | 20 |
| Methyl heptine carbonate | 1 |
| Phenylacetaldehyde dimethyl acetal | 20 |
| Diethyl phthalate | 10 |
| | 1000 pts. |

The addition of N-(2-furfuryl)-pyrrole in the range of 0.5–1.0% to the foregoing rose composition imparts a great lift to the rich, tenacious rose odor.

EXAMPLE III

The use of N-(2-furfuryl)-pyrrole in a citrus composition is illustrated in the following lemon oil base.

| LEMON OIL BASE | |
|---|---|
| Component | Parts |
| α-Pinene | 21 |
| β-Pinene | 102 |
| Myrcene | 18 |
| d-Limonene | 728 |
| p-Cymene | 4 |
| Terpinolene V | 5 |
| Citral | 18 |
| Linalool | 2 |
| α-Terpineol | 4 |
| Lemon oil, California | 33 |
| Diethyl phthalate | 65 |
| | 1000 pts. |

The addition of N-(2-furfuryl)-pyrrole in the range of 0.01–0.05% to the foregoing synthetic lemon oil imparts a natural lemon peel character to the composition. Furthermore, the sharpness of the limonene terpene odor is rounded-off and made more natural.

EXAMPLE IV

The use of N-(2-furfuryl)-pyrrole in a woody composition is illustrated in the following vetiver base.

| VETIVER BASE | |
|---|---|
| Component | Parts |
| Vetiver oil, Bourbon | 200 |
| Vetiver, rectified | 290 |
| Santalol | 200 |
| Laurine | 90 |
| Cinnamic alcohol | 50 |
| Heliotropin | 60 |
| Coumarin | 30 |
| Musk Ketone | 50 |
| Musk Ambrette | 30 |
| | 1000 pts. |

The addition of N-(2-furfuryl)-pyrrole in the range of 0.01–0.06% to the foregoing vetiver base enhances the woody character and blends the composition into a more natural quality.

EXAMPLE V

The use of N-(2-furfuryl)-pyrrole in a special application in fine perfumery is illustrated in the following Chypre accord.

| CHYPRE ACCORD | |
|---|---|
| Component | Parts |
| Absolute Oakmoss | 600 |
| Patchouli | 200 |
| Musk Ketone | 100 |
| Diethyl phthalate | 100 |
| | 1000 pts. |

Addition of 0.2% of N-(2-furfuryl)-pyrrole to the above composition accentuates the woody, mossy character with a special lift to the oakmoss.

The addition of 0.4% of N-(2-furfuryl)-pyrrole to the above composition modifies the oakmoss character of the odor by shifting it toward a seaweed, seashore type of odor.

We claim:

1. A method for improving fragrance compositions which include constituents other than natural oils wherein the improvement comprises adding thereto an olfactorily effective amount of N-(2-furfuryl)-pyrrole to impart naturalness and lift.

2. The method of claim 1 wherein the amount of N-(2-furfuryl)-pyrrole added is from 0.005 to 1.0% of the fragrance base.

3. The method of claim 1 wherein the fragrance composition has a floral odor.

4. The method of claim 3 wherein the floral composition has a geranium or rose odor.

5. The method of claim 1 wherein the fragrance composition has a citrus odor.

6. The method of claim 1 wherein the fragrance composition has a woody odor.

7. The method of claim 1 wherein the fragrance composition is a synthetic substitute of a natural oil.

8. An improved fragrance composition which includes constituents other than natural oils wherein the improvement has been effected by adding thereto an olfactorily effective amount of N-(2-furfuryl)-pyrrole to impart naturalness and lift.

9. The composition of claim 8 wherein the amount of N-(2-furfuryl)-pyrrole added is from 0.005 to 1.0% of the fragrance base.

10. A composition of claim 8 which has a floral odor.

11. A composition of claim 8 which has a citrus odor.

12. A composition of claim 8 which has a woody odor.

13. A composition of claim 8 which is a synthetic substitute of a natural oil.

* * * * *